US005335451A

United States Patent [19]

Druzynski

[11] Patent Number: 5,335,451

[45] Date of Patent: Aug. 9, 1994

[54] INSULATED SMOKE DOORS FOR COOLER/FREEZER APPLICATIONS

[75] Inventor: Frank C. Druzynski, Daytona Beach, Fla.

[73] Assignee: Aluma Shield Industries, Inc., Daytona Beach, Fla.

[21] Appl. No.: 968,440

[22] Filed: Oct. 29, 1992

[51] Int. Cl.[5] ..... E05F 1/08

[52] U.S. Cl. ..... 49/379; 49/386; 49/8

[58] Field of Search ..... 49/5, 6, 7, 8, 386, 49/379, 110, 236; 16/1 C

[56] References Cited

U.S. PATENT DOCUMENTS

| | | | |
|---|---|---|---|
| 796,933 | 8/1905 | Reed | 49/7 |
| 2,909,254 | 10/1959 | Hallock | 49/386 |
| 2,983,343 | 5/1961 | Lyons | 49/8 |
| 3,323,438 | 6/1967 | Korff | 49/8 |
| 3,516,210 | 6/1970 | Jentoft et al. | 49/8 |
| 3,601,437 | 8/1971 | Lyons | 49/7 X |
| 3,830,016 | 8/1974 | Levine | 49/8 |
| 3,869,873 | 3/1975 | Thomas | 49/478 X |
| 3,896,595 | 7/1975 | Anghinetti et al. | 49/386 X |
| 4,090,437 | 5/1978 | Bogaert | 49/8 X |
| 4,517,765 | 5/1985 | Mucha | 49/8 X |

*Primary Examiner*—Michael Milano
*Attorney, Agent, or Firm*—Harness, Dickey & Pierce

[57] ABSTRACT

A heavily insulated emergency smoke hatch door is equipped with an operating mechanism which is located external to a cooler and/or freezer. This external location of the operating mechanism provides for the accommodation of heavier weight doors without effecting the venting area or access to the interior of the cooler and/or freezer. A latching mechanism keeps the door in the closed position and may be equipped with an automatic release device which will release the door upon sensing of a fire for heat within the cooler and/or freezer. Once the hatch door is released, the operating mechanism is operable to open the door for venting and access.

14 Claims, 3 Drawing Sheets

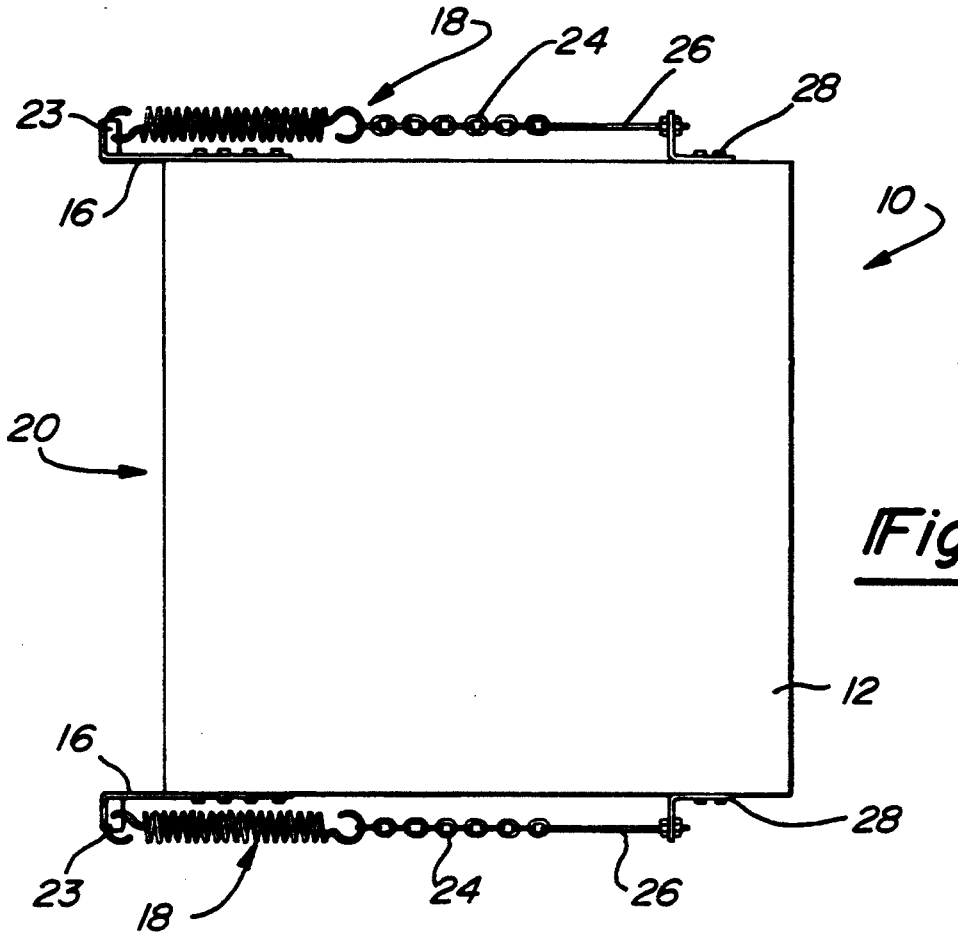
Fig-3
Fig-4
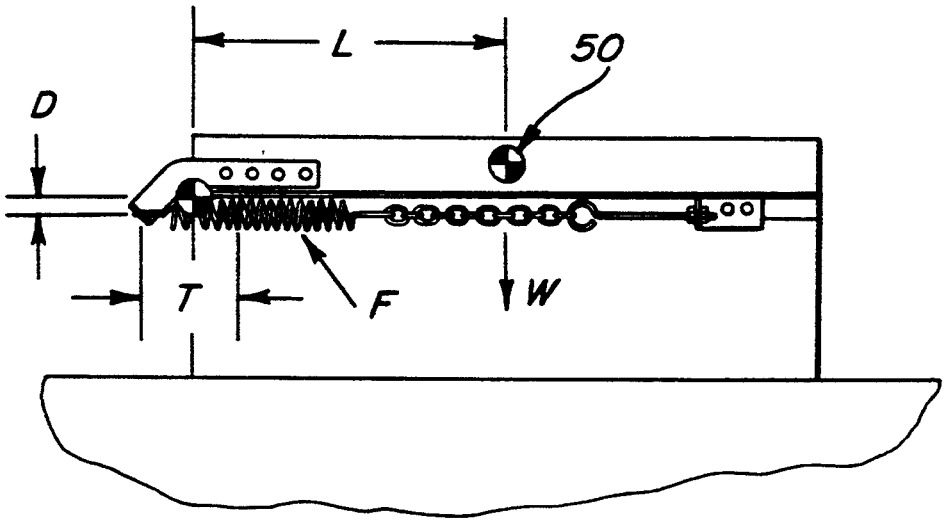

INSULATED SMOKE DOORS FOR COOLER/FREEZER APPLICATIONS

FIELD OF THE INVENTION

The present invention relates to emergency smoke hatch doors. More particularly, the present invention relates to heavily insulated emergency smoke hatch doors for cooler and/or freezer room installations.

BACKGROUND OF THE INVENTION

The food/beverage processing/warehouse industries utilize a wide variety of sealed containers and rooms requiring specialized doors for access or entry. The various types of sealed containers and rooms include coolers, freezers, industrial buildings, constant temperature and humidity rooms, ripening rooms, clean rooms and the like. Most of the above applications have specialized doors which require the emergency venting of smoke in the event of a fire. The same specialized door which provides for venting of smoke in the event of a fire may also be used to provide access to the room for the fire fighting personnel. When the container or room utilizes a hatch type of door for this purpose, design problems for the door may be incurred, especially when the door is to be used for a cooler and/or freezer.

While there are a number of emergency smoke hatch doors available today, none of the these doors are effective when the insulation requirements for a cooler or freezer need to be considered. The emergency smoke hatch doors available today are available with only some light degree of insulation. The door requirements for a cooler/freezer include insulation requirements of 4, 5, 6 inches or more of insulating material. When this additional insulation material is added to today's emergency smoke hatch doors, the added weight increases the loading placed on the operating mechanisms which open the door during emergencies. It is found that the existing smoke hatch door operating mechanism designs cannot withstand the stresses imposed by the additional load imposed by doors incorporating added insulation. The existing operating mechanism for emergency smoke hatch doors are normally located inside of the hatch or inside the room or container. Redesigning these existing smoke hatch mechanisms to carry the increase of weight results in cumbersome components that take up additional interior space and restrict access to the interior of the room or container due to their larger size. In addition, the larger mechanisms reduce the venting ability of the door and are expensive to manufacture, install and maintain.

Accordingly, it is desirous to provide a smoke hatch operating mechanism which is capable of operating heavier weight insulated doors without taking up additional space, restricting access to, or venting of the interior of the container or room. The operating mechanism should be relatively light weight, inexpensive to manufacture, install and maintain.

SUMMARY OF THE INVENTION

The present invention provides the art with a simplified construction for heavily insulated emergency smoke hatch doors. The operating mechanism is placed outside of the smoke hatch door opening. This outside positioning allows changes to the lifting mechanism to accommodate the heavier weight doors without effecting the venting area of or access to the interior of the container or room. The lifting mechanism of the present invention includes an arm bolted to the smoke hatch door and an extension spring instead of the combination of complex springs, weights and lever arm mechanisms found in current designs.

From the subsequent detailed description, appended claims and drawings, other object and advantages of the present invention will become apparent to those skilled in the art.

DESCRIPTION OF THE DRAWINGS

FIG. 3 is a top view of the smoke hatch door shown in FIG. 1.

FIG. 4 is a side view of the smoke hatch door of FIG. 1 shown in the closed position and showing the relationship necessary for determining the loading parameters for the operating mechanism.

DETAILED DESCRIPTION OF THE PREFERRED EMBODIMENT

Figure 2:
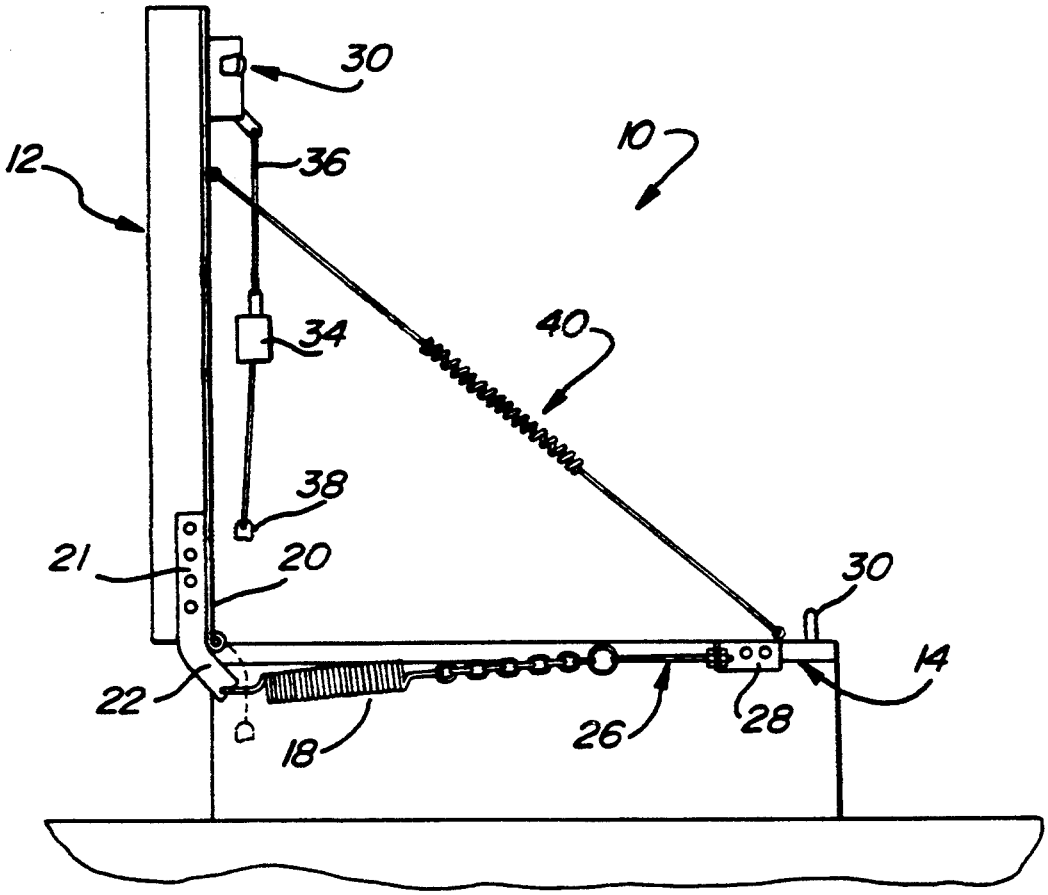
FIG. 2 is a side view of the smoke hatch door of FIG. 1 shown in the open position.
Figure 1:
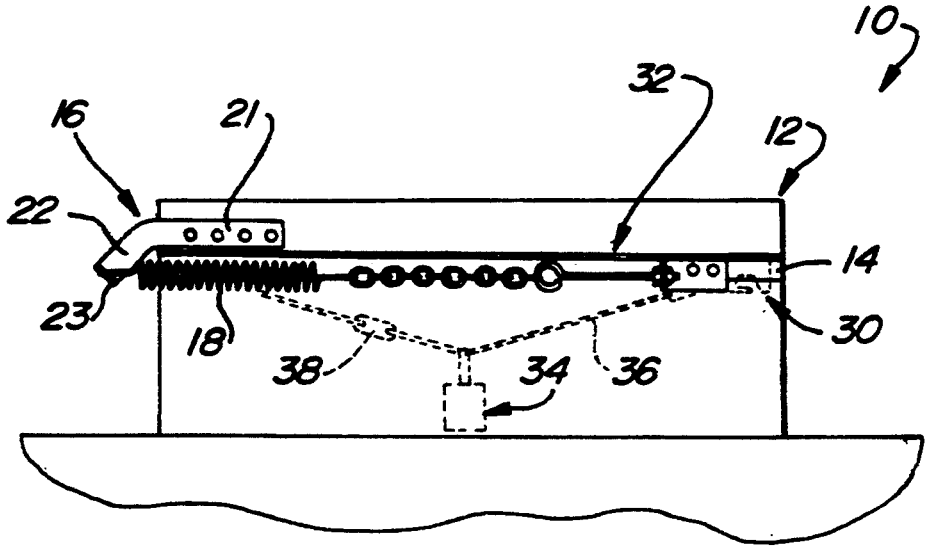
FIG. 1 is a side view of a smoke hatch door in the closed position incorporating the operating mechanism of the present invention.

The emergency smoke hatch door and operating mechanism of the present invention are shown in FIGS. 1 through 3 and are designated by the reference numeral 10. Door 10 comprises an insulated door plug 12, a frame 14, a pair of extension arms 16 and a pair of extension springs 18. Insulated door plug 12 is supported on frame 14 at one end by a hinge 20. Each extension arm 16 is secured to a side of door plug 12 as shown in FIGS. 1 through 3 and includes a generally flat portion 21 adapted to be secured to the side of door plug 12. Extension arms 16 are shown, by way of example, bolted to door plug 12. One end 22 of each flat portion 21 extends past door plug 12 and is angled downward as shown in FIGS. 1 and 2. Extending from end 22 of each extension arm 16 is a spring mounting tab 23 which extends generally perpendicular to extension arms 16 and is adapted for attachment to extension springs 18. Each extension spring 18 is attached at one end to a respective extension arm 16. The opposite end of each extension spring 18 is attached to a length of flexible chain 24. Flexible chain 24 is provided to accommodate possible misalignment during installation and operation of door 10. The opposite end of flexible chain 24 is attached to an adjustable eye bolt 26 which, in turn is attached to a mounting bracket 28. Mounting bracket 28 is securely attached to frame 14. A latching device 30 is used to hold door plug 12 in the closed position against the load of extension springs 18. When door plug 12 is closed as shown in FIG. 1, a gasket 32 seals the interior of frame 14 from the exterior environment. Gasket 32 is of a design well known in the art and may include electrically heated cables to keep gasket 32 frost free.

The operation of emergency smoke hatch door 10 begins in the closed position as shown in FIG. 1. Door plug 12 is held in the closed position as shown by latching device 30. Extension springs 18 are in an extended position exerting a load on extension arms 16. The load exerted by extension springs 18 is attempting to open door plug 12. A weight 34 is suspended between latching device 30 and frame 14 or door plug 12 by a cable 36. Cable 36 is a continuous cable having a fusible link 38 located somewhere along its length between weight 34 and the attachment to frame 14 or door plug 12. When excessive heat caused by a combustion or fire melts fusible link 38, weight 34 is allowed to fall and the resulting force on the actuating lever of latching device 30 releases latching device 30 allowing door plug 12 to swing open under the stored force of extension springs 18 operating on extension arms 16 as shown in FIG. 2. Some larger door plugs 12 may tend to open too quickly due to a build up of kinetic energy resulting from the combination of the force exerted by extension springs 18 and the inertia of door plug 12. In such cases, it may be desirable to include a snubber spring 40. Snubber spring 40 could be replaced by a hydraulic or an air shock absorber to slow down the end travel of door plug 12 and reduce any forces that the inertia of door plug 12 could transfer into frame 14.

While the above detailed description has described a heat fusible link for triggering latch device 30, devices other than fusible links can be used to trigger the opening of door plug 12. The opening of latch device 30 can be triggered electrically with a signal from a smoke detector or other type of fire alarm device as well as being opened manually.

Figure 5:
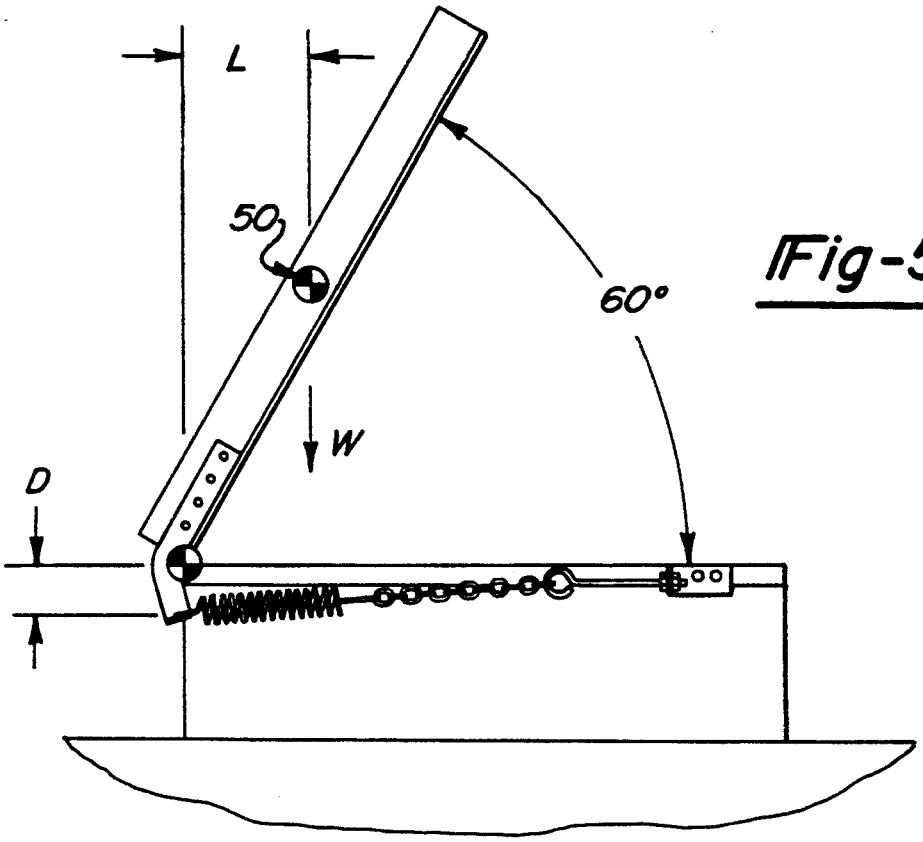
FIG. 5 is a side view of the smoke hatch door of FIG. 1 shown in the partially open position and showing the relationship necessary for determining the loading parameters for the operating mechanism.
Figure 6:
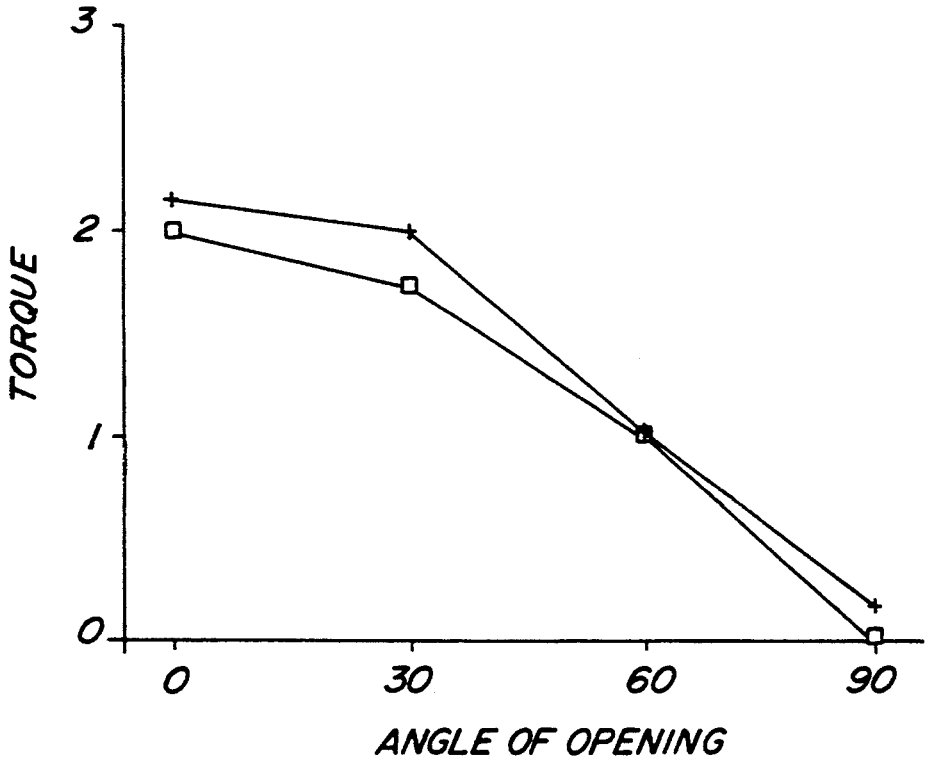
FIG. 6 is a graph of forces on the smoke hatch door versus the opening angle of the door.

The operating principle of emergency smoke hatch door 10 is illustrated in FIGS. 4 through 6. In FIG. 4, door 10 is shown in the fully closed position and in FIG. 5 door 10 is shown in a partially open position. As can be ascertained from these Figures, and as is detailed below, the operating principle of door 10 is to balance the moment caused by the spring force of extension springs 18 acting on extension arms 16 by the weight of door plug 12. This is accomplished as follows.

F is the spring force acting between extension arms 16 and mounting bracket 28.

D is the effective lever arm between the attachment of extension springs 18 to extension arms 16 and the axis of door hinge 20.

W is the weight of door plug 12 at its center of gravity 50.

L is the distance from the center of gravity 50 and the axis of door hinge 20.

Thus, the equation for this operating principle can be written as:

$$F \times D = W \times L$$

The distances D and L are known from the design of door 10 and the weight of door plug 12 can be calculated or door plug 12 can simply be weighed prior to installation and selection of extension springs 18. Once these three variables are known, the initial spring force required by extension springs 18 to open door plug 12 from the closed position can be easily calculated.

FIG. 6 shows a plot of the torque or moment generated by the weight of door plug 12 as it travels from a closed position (0 degrees in FIG. 6) to a fully opened position (90 degrees in FIG. 6). The torque generated by extension springs 18 must necessarily match this same rate of force change. In actuality, the rate of required spring force change is the spring rate measured from the extended condition (door plug 12 closed) to the relaxed condition (door plug 12 open). In the fully extended position, extension springs 18 are set at their maximum load condition (F is at a maximum). In the fully relaxed condition, extension springs are at their minimum load condition (F is equal to 0). Thus, the required spring rate for extension springs 18 for a particular door design can readily be calculated by dividing the maximum spring force required by the horizontal travel of the lever arm (T in FIG. 4), or:

$$\text{Required Spring Rate} = F/T$$

While theoretically, the force exerted by extension springs 18 with door plug 12 fully open can be considered to be zero, some additional preload of extension springs 18 is required when door plug 12 is fully open as well as when it is fully closed. This additional preload of extension springs 18 is required to offset the difference in the rate of change in the force exerted by door plug 12 versus that of extension springs 18 as door plug 12 moves from a fully closed to a fully open position, see FIG. 6. If the extension spring force torque curve 60 in FIG. 6 would begin at the same point as the door torque curve 62 at the door closed or 0° angle position, then the corresponding spring force curve would fall below the door torque curve at the 60° open position. In addition, spring force preload is desirable to offset snow loads that may accumulate on the top of door plug 12 in the closed position and some spring preload is also desirable to offset wind loads on the back side of door plug 12 when it is in the open position. The spring force curve 60 in FIG. 6 has been offset by the addition of spring force preload for these purposes.

While the above detailed description describes the preferred embodiment of the present invention, it should be understood that the present invention is susceptible to modification, variation and alteration without deviating from the scope and fair meaning of the subjoined claims.

What is claimed is:

1. A heavily insulated smoke hatch door for a cooler or freezer, said smoke hatch door comprising:

a frame disposed within an opening in said cooler or freezer, said frame defining a chamber in communication with the interior of said cooler or freezer;

a heavily insulated door plug having one end pivotally secured to said frame, said door plug moveable between an open position and a closed position;

extension spring means for urging said door plug into said opening position, said extension spring means disposed outside of said chamber defined by said frame and outside of said cooler or freezer, said extension spring means coupled with said pivot end of said door plug and said frame;

latching means for holding said door plug in said closed position against the urging of said extension spring means; and a gasket disposed between said door plug and said frame when said door plug is in said closed position, said gasket operable to seal said opening in said cooler or freezer.

2. The heavily insulated smoke hatch door of claim 1 wherein said gasket is electrically heated to prevent the build-up of frost.

3. The heavily insulated smoke hatch door of claim 1 further comprising automatic release means for releasing said latching means such that said extension spring means moves said door plug from said closed position to said open position.

4. The heavily insulated smoke hatch door of claim 3 wherein said automatic release means includes a heat actuated fusible link.

5. The heavily insulated smoke hatch door of claim 3 wherein said automatic release means includes a heat actuated electrical solenoid.

6. The heavily insulated smoke hatch door of claim 1 wherein said extension spring means is positioned such that said opening in said cooler or freezer remains totally open when said door plug is in said open position.

7. The heavily insulated smoke hatch door of claim 1 further comprises:

at least one extension arm secured to said door plug;

at least one said extension spring means attached at one end to said at least one extension arm and attached at the opposite end to said frame.

8. The heavily insulated smoke hatch door of claim 7 wherein said extension spring means has sufficient preload when said door plug is located in said closed position to overcome the weight of said door and a predetermined additional weight to move said door from said closed position to said open position when said latching means is released.

9. The heavily insulated smoke hatch door of claim 7 wherein said extension spring means has sufficient preload when said door plug is located in said open position to resist movement of said door plug from said open position to said closed position when a predetermined amount of force is applied to said door plug.

10. A heavily insulated smoke hatch door for a cooler or freezer, said smoke hatch door comprising:

a frame disposed within an opening in said cooler or freezer, said frame defining a chamber in communication with the interior of said cooler or freezer;

a heavily insulated door plug having an end pivotally secured to said frame, said door plug moveable between an open position and a closed position;

a gasket disposed between said door plug and said frame when said door plug is in said closed position, said gasket operable to seal said opening in said cooler or freezer;

a pair of extension arms positioned outside of said chamber defined by said frame and outside of said cooler or freezer, each extension arm secured to a side of the pivot end of said door plug;

a pair of extension springs position outside of said chamber defined by said frame and outside of said cooler or freezer, each extension spring attached at one end to a respective extension arm and at the opposite end to said frame, said extension springs urging said door plug from said closed position towards said open position; and latching means for holding said door plug in said closed position against the urging of said pair of extension springs.

11. The heavily insulated smoke hatch door of claim 10 further comprising automatic release means for releasing said latching means such that said extension springs move said door plug from said closed position to said open position.

12. The heavily insulated smoke hatch door of claim 11 wherein said automatic release means includes a heat actuated fusible link.

13. The heavily insulated smoke hatch door of claim 11 wherein said automatic release means includes a heat actuated electrical solenoid.

14. The heavily insulated smoke hatch door of claim 10 wherein said extension springs and said extension arms are positioned such that said opening in said cooler or said freezer remains totally open when said door plug is in said open position.

* * * * *